US006389890B1

(12) United States Patent
Sweetland et al.

(10) Patent No.: US 6,389,890 B1
(45) Date of Patent: May 21, 2002

(54) HYDRAULIC STRAIN SENSOR

(75) Inventors: Matthew Sweetland, Somerville, MA (US); Merlin D. Hansen, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/663,372

(22) Filed: Sep. 12, 2000

Related U.S. Application Data

(63) Continuation of application No. 09/267,498, filed on Mar. 12, 1999, now abandoned.

(51) Int. Cl.[7] ..... E21B 44/00; E21B 45/00; E21B 47/06

(52) U.S. Cl. ..... 73/152.48; 73/152.46; 73/152.27; 166/250.07; 166/254.2

(58) Field of Search ..... 73/152.59, 152.27, 73/152.55, 784, 783, 720, 152.46–0.48, 152.22–0.27, 152.31–0.55; 175/40, 48, 50; 166/250.01–250.07, 250.1, 254.2–264

(56) References Cited

U.S. PATENT DOCUMENTS

| | | | | | |
|---|---|---|---|---|---|
| 2,681,567 | A | * | 6/1954 | Widess | 73/151 |
| 3,465,582 | A | | 9/1969 | Richter, Jr. et al. | 73/152 |
| 3,627,065 | A | | 12/1971 | Murphy | 175/48 |
| 3,855,853 | A | * | 12/1974 | Claycomb | 73/151 |
| 3,991,610 | A | | 11/1976 | Rakar et al. | 73/151 |
| 4,157,528 | A | * | 6/1979 | Shuck et al. | 338/42 |
| 4,266,606 | A | * | 5/1981 | Stone | 166/113 |
| 4,294,318 | A | | 10/1981 | Desbrandes et al. | 175/321 |
| 4,359,898 | A | | 11/1982 | Tanguy et al. | 73/151 |
| 4,524,324 | A | * | 6/1985 | Dickinson, III | 324/323 |
| 4,608,861 | A | | 9/1986 | Wachtler et al. | 73/151 |
| 4,676,310 | A | * | 6/1987 | Scherbatskoy et al. | 166/65.1 |
| 4,693,335 | A | | 9/1987 | Almon | 181/102 |
| 4,760,741 | A | | 8/1988 | Koopmans et al. | 73/784 |
| 4,805,449 | A | | 2/1989 | Das | 73/151 |
| 4,860,580 | A | | 8/1989 | DuRocher | 73/155 |
| 4,896,722 | A | * | 1/1990 | Upchurch | 166/250 |
| 5,048,344 | A | | 9/1991 | Herget et al. | 73/784 |
| 5,050,690 | A | * | 9/1991 | Smith | 175/50 |
| 5,065,619 | A | | 11/1991 | Myska | 73/152 |
| 5,099,700 | A | | 3/1992 | Morin et al. | 73/862.04 |
| 5,184,508 | A | | 2/1993 | Desbrandes | 73/152 |
| 5,205,164 | A | * | 4/1993 | Steiger et al. | 73/153 |
| 5,329,811 | A | | 7/1994 | Schultz et al. | 73/155 |
| 5,343,963 | A | | 9/1994 | Bouldin et al. | 175/27 |
| 5,517,854 | A | | 5/1996 | Plumb et al. | 73/151 |
| 5,623,993 | A | * | 4/1997 | Van Buskirk et al. | 166/292 |
| 5,900,545 | A | | 5/1999 | Sacks et al. | 73/152.52 |
| 6,055,213 | A | * | 4/2000 | Rubbo et al. | 367/82 |
| 6,209,391 | B1 | * | 4/2001 | Dallas | 73/152.46 |

OTHER PUBLICATIONS

Model Slickline Initiation Device; Petroleum Engineering Services Limited; Oct. 4, 1995; pp. 1–11.

* cited by examiner

*Primary Examiner*—Hezron Williams
*Assistant Examiner*—David J. Wiggins
(74) *Attorney, Agent, or Firm*—Trop, Pruner & Hu P.C.

(57) ABSTRACT

A hydraulic strain sensor for use with a downhole tool includes a housing having two chambers with a pressure differential between the two chambers. A mandrel is disposed in the housing. The mandrel is adapted to be coupled to the tool such that the weight of the tool is supported by the pressure differential between the two chambers. A pressure-responsive sensor in communication with the one of the chambers is provided to sense pressure changes in the chamber as the tool is accelerated or decelerated and to generate signals representative of the pressure changes.

41 Claims, 2 Drawing Sheets

HYDRAULIC STRAIN SENSOR

This application is a continuation and claims the benefit under 35 U.S.C. §120 to U.S. patent application Ser. No. 09/267,498 filed by Sweetland et al. on Mar. 12, 1999, which patent application became abandoned on Oct. 27, 2000.

BACKGROUND OF THE INVENTION

1. Technical Field

The invention relates generally to electrical downhole tools which are employed for various downhole oil-field applications, e.g., firing shaped charges through a casing and setting a packer in a wellbore. More particularly, the invention relates to a pressure-actuated downhole tool and a method and an apparatus for generating pressure signals which may be interpreted as command signals for actuating the downhole tool.

2. Background Art

Electrical downhole tools which are used to perform one or more operations in a wellbore may receive power and command signals through conductive logging cables which run from the surface to the downhole tools. Alternatively, the downhole tool may be powered by batteries, and commands may be preprogrammed into the tool and executed in a predetermined order over a fixed time interval, or command signals may be sent to the tool by manipulating the pressure exerted on the tool. The downhole pressure exerted on the tool is recorded using a pressure gage, and downhole electronics and software interpret the pressure signals from the pressure gage as executable commands. Typically, the downhole pressure exerted on the tool is manipulated by surface wellhead controls or by moving the tool over set vertical distances and at specified speeds in a column of fluid. However, generating pressure signals using these typical approaches can be difficult, take excessively long periods of time to produce, or require too much or unavailable equipment. Thus, it would be desirable to have a means of quickly and efficiently generating pressure signals.

SUMMARY OF THE INVENTION

In general, in one aspect, a hydraulic strain sensor for use with a downhole tool comprises a housing having two chambers with a pressure differential between the two chambers. A mandrel disposed in the housing is adapted to be coupled to the tool such that the weight of the tool is supported by the pressure differential between the two chambers. A pressure-responsive member in communication with one of the chambers is arranged to sense pressure changes in the one of the chambers as the tool is accelerated or decelerated and to generate signals representative of the pressure changes.

Other aspects and advantages of the invention will be apparent from the following description and the appended claims.

DETAILED DESCRIPTION

Figure 1:
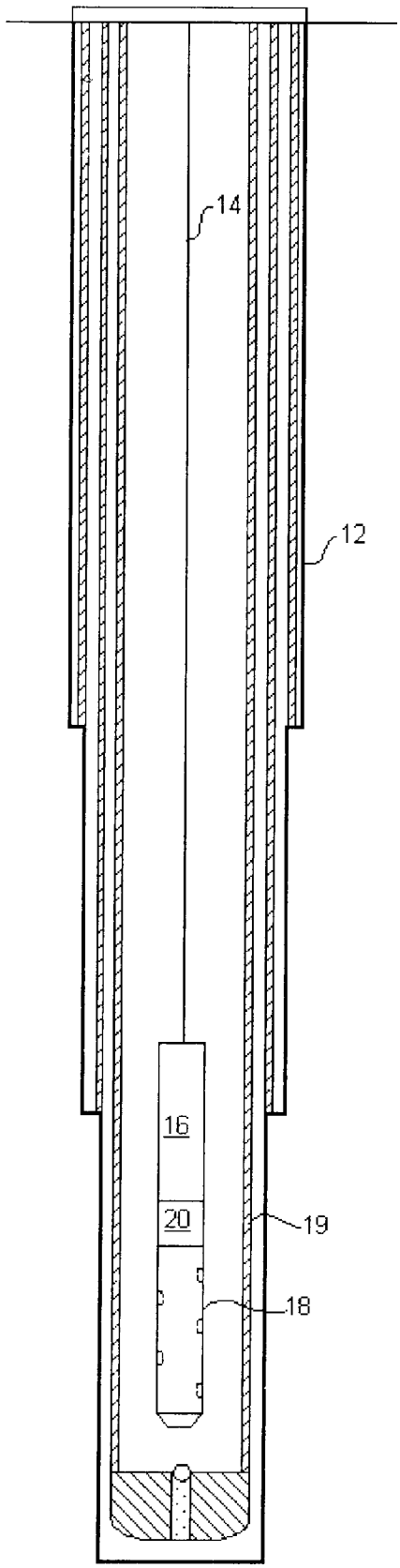
FIG. 1 is a schematic illustration of a downhole assembly for use in performing a downhole operation in a wellbore.

Referring to the drawings wherein like characters are used for like parts throughout the several views, FIG. 1 depicts a downhole assembly 10 which is suspended in a wellbore 12 on the end of a conveyance device 14. The conveyance device 14 may be a slickline, wireline, coiled tubing, or drill pipe. Although running the downhole assembly into the wellbore on a slickline or wireline is considerably faster and more economical than running on a coiled tubing or drill pipe. The downhole assembly 10 includes a hydraulic strain sensor 16 and a downhole tool 18 which may be operated to perform one or more downhole operations in response to pressure signals generated by the hydraulic strain sensor 16. For example, the downhole tool 18 may be a perforating gun which may be operated-to fire shaped charges through a casing 19 in the wellbore 12.

The hydraulic strain sensor 16 includes a sealed chamber (not shown) which experiences pressure changes when the downhole tool 18 is accelerated or decelerated and a pressure-responsive sensor, e.g., a pressure transducer (not shown), which detects the pressure changes and converts them to electrical signals. The hydraulic strain sensor 16 communicates with the downhole tool 18 through an electronics cartridge 20. The electronics cartridge 20 includes electronic circuitry, e.g., microprocessors (not shown), which interprets the electrical signals generated by the pressure transducer as commands for operating the downhole tool 18. The electronics cartridge 20 may also include an electrical power source, e.g., a battery pack (not shown), which supplies power to the electrical components in the downhole assembly 10. Power may also be supplied to the downhole assembly 10 from the surface, e.g., through a wireline, or from a downhole autonomous power source.

Figure 2:
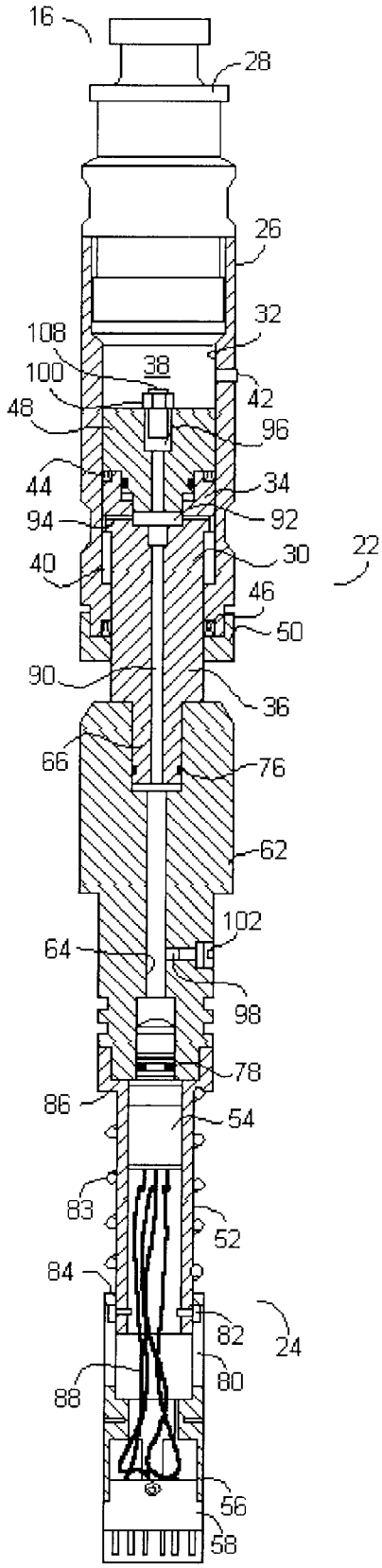
FIG. 2 is a detailed view of the hydraulic strain sensor shown in FIG. 1.

Referring to FIG. 2, the hydraulic strain sensor 16 comprises a hydraulic power section 22 and a sensor section 24. The hydraulic power section 22 includes a cylinder 26. A fishing neck 28 is mounted at the upper end of the cylinder 26 and adapted to be coupled to the conveyance device 14 (shown in FIG. 1) so that the hydraulic strain sensor 16 can be lowered into and retrieved from the wellbore on the conveyance device. With the fishing neck 28 coupled to the conveyance device 14, the hydraulic strain sensor 16 and other attached components can be accelerated or decelerated by jerking the conveyance device. The fishing neck 28 may also be coupled to other tools. For example, if the conveyance device 14 is inadvertently disconnected from the fishing neck 28 so that the hydraulic strain sensor 16 drops to the bottom of the wellbore, a fishing tool, e.g., an overshot, may be lowered into the wellbore to engage the fishing neck 28 and retrieve the hydraulic strain sensor 16. The fishing neck 28 may be provided with magnetic markers (not shown) which allow it to be easily located downhole.

A mandrel 30 is disposed in and axially movable within a bore 32 in the cylinder 26. The mandrel 30 has a piston portion 34 and a shaft portion 36. An upper chamber 38 is defined above the piston portion 34, and a lower chamber 40 is defined below the piston portion 34 and around the shaft portion 36. The upper chamber 38 is exposed to the pressure outside the cylinder 26 through a port 42 in the cylinder 26. A sliding seal 44 between the piston portion 34 and the cylinder 26 isolates the upper chamber 38 from the lower chamber 40, and a sliding seal 46 between the shaft portion 34 and the cylinder 26 isolates the lower chamber 40 from the exterior of the cylinder 26. The sliding seal 44 is retained on the piston portion 34 by a seal retaining plug 48, and the sliding seal 46 is secured to a lower end of the cylinder 26 by a seal retaining ring 50.

The sensor section 24 comprises a first sleeve 52 which encloses and supports a pressure transducer 54 and a second sleeve 56 which includes an electrical connector 58. The first sleeve 52 is attached to the lower end of a connecting body 62 with a portion of the pressure transducer 54 protruding into a bore 64 in the connecting body 62. An end 66 of the shaft portion 36 extends out of the cylinder 26 into the bore 64 in the connecting body 62. The end 66 of the shaft portion 26 is secured to the connecting body 62 so as to allow the connecting body 62 to move with the mandrel 30. Static seals, e.g., o-ring seals 76 and 78, are arranged between the connecting body 62 and the shaft portion 36 and pressure transducer 54 to contain fluid within the bore 64.

The second sleeve 56 is mounted on the first sleeve 52 and includes slots 80 which are adapted to ride on projecting members 82 on the first sleeve 52. When the slots 80 ride on the projecting members 82, the hydraulic strain sensor 16 moves relative to the downhole tool 18 (shown in FIG. 1). A spring 82 connects and normally biases an upper end 84 of the second sleeve 56 to an outer shoulder 86 on the first sleeve 52. The electrical connector 58 on the second sleeve 52 is connected to the pressure transducer 54 by electrical wires 88. When the hydraulic strain sensor 16 is coupled to the electronics cartridge 20 (shown in FIG. 1), the electrical connector 58 forms a power and communications interface between the pressure transducer 54 and the electronic circuitry and electrical power source in the electronics cartridge.

The shaft portion 36 has a fluid channel 90 which is in communication with the bore 64 in the connecting body 62. The fluid channel 90 opens to a bore 92 in the piston portion 34, and the bore 92 in turn communicates with the lower chamber 40 through ports 94 in the piston portion 34. The bore 92 and ports 94 in the piston portion 34, the fluid channel 90 in the shaft portion 36, and the bore 64 in the connecting body 62 define a pressure path from the lower chamber 40 to the pressure transducer 54. The lower chamber 40 and the pressure path are filled with a pressure-transmitting medium, e.g., oil or other incompressible fluid, through fill ports 96 and 98 in the seal retaining plug 48 and the connecting body 62, respectively. By using both fill ports 96 and 98 to fill the lower chamber 40 and the pressure path, the volume of air trapped in the lower chamber and the pressure path can be minimized. Plugs 100 and 102 are provided in the fill ports 96 and 98 to contain fluid in the pressure path and the lower chamber 40.

When the hydraulic strain sensor 16 is coupled to the downhole tool 18, as illustrated in FIG. 1, the net force, $F_{net}$, resulting from the pressure differential across the piston portion 34 supports the weight of the downhole tool 18. The net force resulting from the pressure differential across the piston portion 34 can be expressed as:

$$F_{net}=(P_{lc}-P_{uc})\cdot A_{lc} \tag{1}$$

where $P_{lc}$ is the pressure in the lower chamber 40, $P_{uc}$ is the pressure in the upper chamber 38 or the wellbore pressure outside the cylinder 26, $A_{lc}$ is the cross-sectional area of the lower chamber 40.

The total force, $F_{total}$, that is applied to the piston portion 34 by the downhole tool 18 can be expressed as:

$$F_{total}=m_{tool}(g-a)+F_{drag} \tag{2}$$

where $m_{tool}$ is the mass of the downhole tool 18, g is the acceleration due to gravity, a is the acceleration of the downhole tool 18, and $F_{drag}$ is the drag force acting on the downhole tool 18. Drag force and acceleration are considered to be positive when acting in the same direction as gravity.

Assuming that the weight of the sensor section 24 and the weight of the connecting body 62 is negligibly small compared to the weight of the downhole tool 18, then the net force, $F_{net}$, resulting from the pressure differential across the piston portion 34 can be equated to the total force, $F_{total}$, applied to the piston portion 34 by the downhole tool 18, and the pressure, $P_{lc}$, in the lower chamber 40 can then be expressed as:

$$P_{lc}=\frac{1}{A_{lc}}[m_{tool}\cdot(g-a)+F_{drag}+P_{uc}\cdot A_{lc}] \tag{3}$$

From the expression above, it is clear that the pressure, $P_{lc}$, in the lower chamber 40 changes as the downhole tool 18 is accelerated or decelerated. These pressure changes are transmitted to the pressure transducer 54 through the fluid in the lower chamber 40 and the pressure path. The pressure transducer 54 responds to the pressure changes in the lower chamber 40 and converts them to electrical signals. For a given acceleration or deceleration, the size of a pressure change or pulse can be increased by reducing the cross-sectional area, $A_{lc}$, of the lower chamber 40.

In operation, the downhole assembly 10 is lowered into the wellbore 12 with the lower chamber 40 and pressure path filled with a pressure-transmitting medium. When the downhole assembly 10 is accelerated in the upward direction, the total force, $F_{total}$, which is applied to the piston portion 34 by the downhole tool 18 increases and results in a corresponding increase in the pressure, $P_{lc}$, in the lower chamber 40. When the downhole tool 18 is accelerated in the downward direction, the force, $F_{total}$, which is applied to the piston portion 34 by the downhole tool 18 decreases and results in a corresponding decrease in the pressure, $P_{lc}$, in the lower chamber 40. The downhole assembly 10 may also be decelerated in either the upward or downward direction to effect similar pressure changes in the lower chamber 40. The pressure changes in the lower chamber 40 are detected by the pressure transducer 54 as pressure pulses. Moving the downhole assembly 10 in prescribed patterns will produce pressure pulses which can be converted to electrical signals that can be interpreted by the electronics cartridge 20 in the downhole tool 18 as command signals.

If the downhole assembly 10 becomes stuck and jars are used to try and free the assembly, the pressure differential across the piston portion 34 can become very high. If the bottom-hole pressure, i.e., the wellbore pressure at the exterior of the downhole assembly 10, is close to the pressure rating of the downhole assembly 10, then the pressure transducer 54 can potentially be subjected to pressures that are well over its rated operating value. To prevent damage to the pressure transducer 54, the fill plug 100 may be provided with a rupture disc 108 which bursts when the pressure in the lower chamber 40 is above the pressure rating of the pressure transducer 54. When the rupture disc 108 bursts, fluid will drain out of the lower chamber 40 and the pressure path, through the fill port 96, and out of the cylinder 26. As the fluid drains out of the lower chamber 40 and the pressure path, the piston portion 34 will move to the lower end of the cylinder 26 until it reaches the end of travel, at which time the hydraulic strain sensor 16 becomes solid and the highest pressure the pressure transducer 54 will be subjected to is the bottom-hole pressure. Instead of using a rupture disc, a check valve or other pressure responsive member may also be arranged in the fill port 96 to allow fluid to drain out of the lower chamber 40 when necessary.

If the downhole assembly 10 becomes unstuck, commands can no longer be generated using acceleration or deceleration of the downhole assembly 10. However, traditional methods such as manipulation of surface wellhead controls or movement of the downhole assembly 10 over fixed vertical distances in a column of liquid can still be used. When traditional methods are used, the pressure transducer 54, which is now in communication with the wellbore, will detect changes in wellbore or bottom-hole pressure around the hydraulic strain sensor 16 and transmit signals that are representative of the pressure changes to the electronics cartridge 20. It should be noted that while the downhole assembly 10 is stuck, pressure signals can still be sent to the downhole tool 18 by alternately pulling and releasing on the conveyance device 14.

The invention is advantageous in that pressure signals can be generated by simply accelerating or decelerating the downhole tool. The pressure signals are generated at the downhole tool and received by the downhole tool in real-time. The invention can be used with traditional methods of pressure-signal transmission, i.e., manipulation of surface wellhead controls or movement of the downhole tool over fixed vertical distances in a column of liquid.

While the invention has been described with respect to a limited number of embodiments, those skilled in the art will appreciate numerous variations therefrom without departing from the spirit and scope of the invention.

What is claimed is:

1. A hydraulic strain sensor for use with a downhole tool in a wellbore, comprising:

a housing having two chambers with a fluid pressure differential between the two chambers;

a mandrel disposed in the housing and adapted to be coupled to the tool such that the weight of the tool is supported by the pressure differential between the two chambers; and a pressure-responsive sensor in fluid communication with one of the chambers, the pressure-responsive sensor being arranged to sense pressure changes in, the one of the chambers as the tool is accelerated or decelerated and to generate signals representative of the pressure changes.

2. The hydraulic strain sensor of claim 1, wherein the pressure-responsive sensor further senses pressure changes in the one of the chambers when there is a change in external force applied to the tool.

3. A hydraulic strain sensor for use with a downhole tool, comprising:

a housing having an end adapted to be coupled to a conveyance device so as to be lowered into a wellbore on the conveyance device, the housing having a first chamber and a second chamber defined therein, the first chamber being exposed to fluid pressure outside the first housing through a port in the housing;

a mandrel slidably disposed in the housing, the mandrel having a piston portion with one side exposed to fluid pressure in the first chamber and another side exposed to fluid pressure in the second chamber;

means for generating pressure signals in response to pressure changes in the second chamber as the tool is accelerated or decelerated; and a fluid path filled with pressure-transmitting medium and arranged to transmit pressure changes in the second chamber to the means for generating pressure signals.

4. A hydraulic strain sensor for use with a downhole tool, comprising:

a first housing having an end adapted to be coupled to a conveyance device so as to be lowered into a wellbore on the conveyance device, the first housing having a first chamber and a second chamber defined therein, the first chamber being exposed to fluid pressure outside the first housing through a port in the housing;

a mandrel slidably disposed in the first housing, the mandrel having a piston portion with one side exposed to fluid pressure in the first chamber and another side exposed to fluid pressure in the second chamber;

a second housing coupled to the mandrel and having a pressure-responsive sensor disposed therein, the second housing being adapted to be coupled to the tool such that the weight of the tool is supported by fluid pressure differential across the piston portion; and a fluid path extending from the second chamber to the pressure-responsive sensor, the fluid path being filled with a pressure-transmitting medium and arranged to transmit pressure changes from the second chamber to the pressure-responsive sensor as the tool is accelerated or decelerated;

wherein the pressure-responsive sensor generates signals representative of the pressure changes in the second chamber and transmits the signals to the tool.

5. The hydraulic strain sensor of claim 4, wherein the fluid path extends through the mandrel and the piston portion includes a port for selective fluid communication between the first chamber and the fluid path.

6. The hydraulic strain sensor of claim 5, wherein a plug is provided to prevent fluid communication between the first chamber and the fluid path.

7. The hydraulic strain sensor of claim 6, wherein the plug includes a pressure-responsive member which allows fluid communication between the first chamber and the fluid path when the pressure in the first chamber reaches a predetermined value.

8. The hydraulic strain sensor of claim 7, wherein the predetermined value is the maximum operating pressure of the pressure-responsive sensor.

9. The hydraulic strain sensor of claim 7, wherein a connecting body couples the mandrel to the sensor housing and the fluid path extends through the connecting body.

10. The hydraulic strain sensor of claim 9, wherein the connecting body includes a port for selective fluid communication with the fluid path.

11. The hydraulic strain sensor of claim 10, wherein the sensor housing includes an electrical connector which is adapted to be connected to the tool and through which signals are transmitted from the pressure-responsive sensor to the tool.

12. A downhole actuating and operating apparatus for use in a wellbore, comprising:

a housing adapted to be lowered into the wellbore, the housing having a first chamber and a second chamber, the first chamber being exposed to pressure outside the housing through a port in the housing, the second chamber being filled with a pressure-transmitting medium;

a mandrel slidably disposed in the housing, the mandrel having a piston portion with one side exposed to fluid pressure in the first chamber and another side exposed to fluid pressure in the second chamber thereby creating a fluid pressure differential across the piston portion;

a downhole tool coupled to the mandrel so as to be supported by the fluid pressure differential across the piston portion; and a pressure-responsive sensor in fluid communication with the second chamber, the pressure-responsive sensor being responsive to pressure changes in the second chamber as the downhole tool is accelerated or decelerated and generating signals representative of the pressure changes;

wherein the tool performs a downhole operation in response to the signals generated by the pressure-responsive sensor.

13. The apparatus of claim 12, wherein the pressure-responsive sensor further senses pressure changes in the second chamber when there is a change in external force applied to the tool.

14. The apparatus of claim 13, wherein the change in external force applied to the tool is generated by pulling on and releasing the tool.

15. A method of generating pressure signals for operating a downhole tool, comprising:

providing a hydraulic strain sensor having a housing with two champs, a mandrel disposed in the housing, and a fluid pressure-responsive sensor in communication with one of the chambers;

providing a fluid pressure differential between the two chambers;

coupling the tool to the mandrel such that the weight of the tool is supported by the pressure differential between the two chambers;

lowering the hydraulic strain sensor and the tool downhole on a conveyance device;

manipulating the conveyance device to accelerate or decelerate the tool;

detecting fluid pressure changes in the one of the chambers using the pressure-responsive sensor; and transmitting signals representative of pressure changes in the one of the chambers to the tool.

16. A downhole assembly for use in a wellbore, comprising:

a housing having a chamber with a fluid disposed therein;

the housing adapted to be coupled to a downhole tool such that the weight of the tool is supported by the fluid in the chamber; and a pressure-responsive sensor in fluid communication with the fluid, the pressure-responsive sensor being arranged to senses pressure changes in the fluid when there is a change in external force applied to the housing, wherein the housing is deployed in the wellbore on a conveyance device, the change in external force is generated by manipulating the conveyance device, the conveyance device is a slickline, and the change in external force is generated by pulling on and/or releasing the slickline.

17. The assembly of claim 16, wherein the operation of the tool is enabled after receipt by the pressure-responsive sensor of a predetermined pattern of pressure changes.

18. The assembly of claim 16, further comprising:

the pressure-responsive sensor being arranged to generate signals representative of the pressure changes;

an electronics cartridge receiving the signals generated by the pressure-responsive sensor; and the electronics cartridge operating the tool upon receipt of a pre-determined signal pattern from the pressure-responsive sensor.

19. The assembly of claim 16, wherein:

the housing is deployed in the wellbore on a conveyance device; and the change in external force is generated by manipulating the conveyance device.

20. The assembly of claim 16, further comprising:

a mandrel slidably disposed in the housing; and the mandrel adapted to be coupled to the tool such that the weight of the tool is supported by the fluid in the chamber.

21. A method of generating signals for operating a downhole tool in a wellbore, comprising:

providing a housing having a chamber and a fluid pressure-responsive sensor in communication with the chamber;

providing a fluid within the chamber;

coupling the tool to the housing such that the weight of the tool is supported by the fluid in the chamber;

changing an external force applied to the housing to create fluid pressure changes in the chamber;

detecting the fluid pressure changes in the chamber using the pressure-responsive sensor; and deploying the hydraulic strain sensor and the tool on a conveyance device, wherein the changing an external force step comprises manipulating the conveyance device, the conveyance device comprises a slickline, and the manipulating step comprises pulling on and/or releasing the slickline.

22. The method of claim 21, further comprising operating the tool after the pressure-responsive sensor detects a pre-determined pattern of pressure changes.

23. The method of claim 21, further comprising:

transmitting signals representative of the pressure changes in the chamber to an electronics cartridge; and operating the tool upon receipt of a pre-determined signal pattern from the pressure-responsive sensor.

24. The method of claim 21, further comprising:

deploying the sensor and the tool on a conveyance device; and the changing an external force step comprises manipulating the conveyance device.

25. A downhole assembly for use in a wellbore, comprising:

a housing having a chamber with a fluid disposed therein;

a mandrel slidably disposed in the housing and adapted to be coupled to a downhole tool such that the mandrel may slide when there is a change in external force applied to the housing thereby changing the pressure in the chamber; and a pressure-responsive sensor in fluid communication with the chamber, the pressure-responsive sensor being arranged to senses pressure changes in the fluid when there is a change in external force applied to the housing, wherein the housing deployed in the wellbore on a conveyance device, the change in external force is generated by manipulating the conveyance device, the conveyance device is a slickline, and the change in external force is generated by pulling on and/or releasing the slickline.

26. The assembly of claim 25, wherein the operation of the tool is enabled after receipt by the pressure-responsive sensor of a pre-determined pattern of pressure changes.

27. The assembly of claim 25, further comprising:

the pressure-responsive sensor being arranged to generate signals representative of the pressure changes;

an electronics cartridge receiving the signals generated by the pressure-responsive sensor; and the electronics cartridge operating the tool upon receipt of a pre-determined signal pattern from the pressure-responsive sensor.

28. The assembly of claim 25, wherein:

the housing is deployed in the wellbore on a conveyance device; and the change in external force is generated by manipulating the conveyance device.

29. A method of generating signals for operating a downhole tool, comprising:

providing a housing with a chamber;

providing a fluid within the chamber;

changing an external force applied to the housing;

providing a mandrel slidably disposed in the housing and adapted to be coupled to a downhole tool such that the mandrel may slide when there is a change in external force applied to the housing thereby changing the pressure in the chamber;

providing a fluid pressure-responsive sensor in communication with the fluid in the chamber;

detecting a fluid pressure changes in the fluid using the pressure-responsive sensor; and deploying the hydraulic strain sensor and the tool on a conveyance device, wherein the changing an external force step comprises manipulating the conveyance device, the conveyance device comprises a slickline, and the manipulating step comprises pulling on and/or releasing the slickline.

30. The method of claim 29, further comprising operating the tool after the pressure-responsive sensor detects a pre-determined pattern of pressure changes.

31. The method of claim 29, further comprising:

transmitting signals representative of the pressure changes in the chamber to an electronics cartridge; and operating the tool upon receipt of a pre-determined signal pattern from the pressure-responsive sensor.

32. The method of claim 29, further comprising:

deploying the sensor and the tool on a conveyance device; and the changing an external force step comprises manipulating the conveyance device.

33. An assembly for use in a wellbore, comprising:

a strain sensor connected to a downhole tool;

the strain sensor adapted to detect a pressure change in a fluid inside the sensor to sense when there is a change in external force applied to the assembly; and the strain sensor adapted to enable the operation of the downhole tool upon sensing a pre-determined pattern of changes in external force applied to the assembly, wherein the hydraulic strain sensor is adapted to be coupled to a conveyance device so as to be lowered into the wellbore, the changes in external force are generated by manipulating the conveyance device, and the conveyance device comprises a slickline.

34. The assembly of claim 33, wherein:

the strain sensor includes a chamber with the fluid disposed therein;

the strain sensor is adapted to sense pressure changes in the fluid caused by changes in external force applied to the assembly; and the strain sensor is adapted to enable the operation of the tool upon sensing a pre-determined pattern of pressure changes in the fluid.

35. The assembly of claim 33, wherein:

the strain sensor is adapted to be coupled to a conveyance device so as to be lowered into the wellbore; and the changes in external force are generated by manipulating the conveyance device.

36. The assembly of claim 33, wherein:

the hydraulic strain sensor is adapted to convert the pattern of changes in external force applied to the assembly into electrical signals; and the operation of the downhole tool is enabled after the conversion of a pre-determined signal pattern.

37. A method of generating signals for operating a downhole tool, comprising:

providing a strain sensor connected to a downhole tool;

changing an external force applied to the strain sensor to change a pressure of fluid inside the sensor;

operating the tool upon sensing a pre-determined pattern of the at least one external force applied to the strain sensor; and lowering the hydraulic strain sensor and downhole tool on a conveyance device, wherein the changing an external force step comprises manipulating the conveyance device, and the conveyance device comprises a slickline.

38. The method of claim 37, wherein:

the strain sensor includes a chamber with the fluid disposed therein;

the sensing step comprises sensing pressure changes in the fluid caused by changes in external force applied to the strain sensor; and the operating step comprises operating the tool upon sensing a pre-determined pattern of pressure changes in the fluid.

39. The method of claim 37, wherein:

lowering the strain sensor and downhole tool on a conveyance device; and the changing an external force step comprises manipulating the conveyance device.

40. The method of claim 39, wherein the manipulating step comprises pulling on and/or releasing the slickline.

41. The method of claim 37, wherein the operating step comprises:

converting the pattern of changes in external force applied to the hydraulic strain sensor into electrical signals; and operating the tool upon conversion of a predetermined signal pattern.

* * * * *